US005284089A

United States Patent [19]

Buck et al.

[11] Patent Number: 5,284,089

[45] Date of Patent: Feb. 8, 1994

[54] PROTECTIVE SYSTEM OF A PILE LIFTING DEVICE FOR SHEET PILES IN SHEET-FED PRINTING MACHINES

[75] Inventors: Helmut Buck, Schriesheim; Udo Ganter, Hirschberg-Leutershausen; Christian Thomas, Walldorf, all of Fed. Rep. of Germany

[73] Assignee: Heidelberger Druckmaschinen AG, Heidelberg, Fed. Rep. of Germany

[21] Appl. No.: 22,054

[22] Filed: Feb. 24, 1993

[30] Foreign Application Priority Data

Feb. 24, 1992 [DE] Fed. Rep. of Germany ..... 9202352

[51] Int. Cl.[5] ..... B41F 13/24

[52] U.S. Cl. ..... 101/232; 101/240; 271/213; 414/788.1

[58] Field of Search ..... 101/232, 233, 238, 239, 101/240, 241; 271/213, 214, 215, 217; 414/788.1, 788.9, 790.8, 792.7

[56] References Cited

U.S. PATENT DOCUMENTS

| | | | |
|---|---|---|---|
| 3,652,083 | 3/1972 | Bosshardt | 101/232 |
| 3,682,328 | 8/1972 | Turner et al. | 271/215 |
| 3,951,251 | 4/1976 | Zaccagnino, Jr. | 101/233 |
| 4,927,131 | 5/1990 | Hashimoto et al. | 271/215 |
| 4,943,043 | 7/1990 | Huggins et al. | 271/213 |
| 4,959,685 | 9/1990 | Kato | 271/214 |
| 4,989,853 | 2/1991 | Matysek et al. | 271/213 |
| 5,098,080 | 3/1992 | Arnone et al. | 271/217 |
| 5,190,281 | 3/1993 | Cardenas | 414/790.8 |
| 5,215,300 | 6/1993 | Hiroi et al. | 271/214 |

*Primary Examiner*—Eugene H. Eickholt
*Attorney, Agent, or Firm*—Herbert L. Lerner; Laurence A. Greenberg

[57] ABSTRACT

Protective system of a pile lifting device for sheet piles in a sheet-fed printing machine, wherein a pile support board is liftable and lowerable in guides of a frame by a motorized drive of a lifting unit having a fast-speed and a slower speed operating condition for both the lifting and lowering, the pile support board and a sheet pile supported thereby, respectively, being drivable by the motorized drive to a position switch and into a collision region wherein it can collide with another machine part, including a control member operative between the pile support board or the sheet pile supported thereby, on one hand, and a machine part present in the collision region, on the other hand, the control member being articulatingly fastened in vicinity of the position switch or to the machine part in the collision region, and having switch elements arranged in at least two switching stages for controlling the lifting unit drive and being switchable via contact surfaces on the pile support board, a first plurality of the switch elements arranged in a first one of the switching stages and a second plurality thereof arranged in a second switching stage, the first plurality thereof being located upstream of the second plurality thereof in a direction towards the collision region, the first plurality thereof being actuatable for switching the lifting unit drive from fast speed operation to a slower speed operation, and the second plurality thereof for switching the lifting unit drive off.

6 Claims, 7 Drawing Sheets

PROTECTIVE SYSTEM OF A PILE LIFTING DEVICE FOR SHEET PILES IN SHEET-FED PRINTING MACHINES

The invention relates to a protective system of a pile lifting device for sheet piles in feeders and deliveries of sheet-fed printing machines and, more particularly, to such a pile lifting device wherein a pile support board for supporting a sheet pile thereon is liftable and lowerable in guides of a frame by a motorized drive of a lifting unit controllable independently of the printing-machine drive, the motorized drive having at least one fast-speed operating condition and one comparatively slower speed operating condition for both the lifting and lowering directions of movement, the pile support board and a sheet pile supported thereby, respectively, being drivable by the motorized drive to a position switch and into a location in which it can collide with another machine part.

Constructions have become known, heretofore, wherein the pile support board is suspended on chains which are connected to the motorized lifting-unit drive. Position or limit switches for switching the lifting-unit drive off are arranged for the upper and the lower end positions of the pile support board and are integrated into the circuit of the lifting-unit drive in order to switch the latter off automatically. Additional position switches located between the end positions are provided to permit the pile support board to be driven to predetermined positions in accordance with the operation of the printing machine. For this purpose contactless transmitters, such as ultrasonic sensors and capacitive transmitters, especially, have become known heretofore and have been installed, moreover, as protection or safety devices for stopping the lifting-unit drive before the pile support board, for example, a pallet, or a sheet pile supported thereby is driven into a location in which a collision may occur.

Due to the high speeds possible with brushless electric drive motors in standard lifting units for lifting and lowering the pile support board with the sheet pile supported thereon or the pile support board alone without an sheet pile disposed thereon, it is necessary to switch over to a slower speed, for example, when approaching a position switch, in order to prevent damage thereto or destruction thereof. This switchover is supposed to be effected in a timely manner by the pressman, so that a lapse of vigilance may result in damage or, contrarily, may also cause unnecessary loss of time.

In pile lifting devices having an auxiliary pile device above a main pile, for example, formed of a guide for a rake or other means for supporting an auxiliary pile horizontally slidable into the guide the latter being also suspended on chains and being vertically movable by an auxiliary pile lifting unit, and other precautionary devices for non-stop operation, promoted by the high speeds primarily when lifting, the main and auxiliary piles can collide with one another. For the same reasons, it is also quite possible that a full sheet pile may be lifted directly into the path of travel of a moving gripper bridge, which can result in the occurrence of considerable damage.

It is accordingly an object of the invention to provide a system both for protecting against approaching a position switch at too great a speed, as well as against a collision of machine parts due to a manually or program-controlled lifting and lowering movement of the pile support board in a pile lifting device.

With the foregoing and other objects in view, there is provided, in accordance with the invention, a protective system of a pile lifting device for sheet piles in feeders and deliveries of sheet-fed printing machines, wherein a pile support board for supporting a sheet pile thereon is liftable and lowerable in guides of a frame by a motorized drive of a lifting unit controllable independently of the printing-machine drive, the motorized drive having at least one fastspeed operating condition and one comparatively slower speed operating condition for both the lifting and lowering directions of movement, the pile support board and a sheet pile supported thereby, respectively, being drivable by the motorized drive to a position switch and into a collision region in which it can collide with another machine part, comprising a control member operative between the pile support board and the sheet pile supported thereby, respectively, on the one hand, and a machine part present in the collision region, on the other hand, the control member being articulatingly fastened to at least one of a location in vicinity of the position switch and the machine part in the collision region, and having switch elements arranged in at least two switching stages for controlling the lifting unit drive, the switch elements being switched via contact surfaces formed on the pile support board and including a first plurality thereof arranged in a first one of the switching stages and a second plurality thereof arranged in a second switching stage, the first plurality of switch elements being located upstream of the second plurality of switch elements in a direction of mutual approach of the pile support board and the machine part in the collision region, the first plurality of switch elements being actuatable for switching the lifting unit drive from fast speed operation to a slower speed operation, and the second plurality of switch elements being actuatable for switching the lifting unit drive off.

By means of such a control member, sensing or detection of the approach of the pile support board and the sheet pile on the pile support board, respectively, to another machine part or to a region wherein another machine part moves in accordance with its operating conditions, is effected either mechanically by contacting a stop and entrainment of the movably linked control member, or electronically, for example, based upon ultrasonics, and movement of the pile support board is switched by the switch elements of a first stage from the fast speed over to a slower or creep speed, so that the switch elements of a second switching stage switch the lifting unit drive off without danger to the machine parts even before the pile support board or a sheet pile on the pile support board engages another machine part or extends into the range or region of displacement of a machine part conditioned upon its operation.

Such a control member can prevent, in a mechanical manner in the sheet feeder, the pile support board and the pallet or another accessory disposed on the pile support board, respectively, from unintentionally accelerating upwardly against suction, conveyor and fanning blower nozzles or other components of the sheet feeder. Furthermore, such a control member in the sheet feeder of a printing machine can mechanically prevent the sheet pile or the empty pile support board from being lifted against the suction roller or into the range of movement of the gripper bridges and of the sheet grippers conveying the oncoming sheets above the sheet pile, respectively. In this regard, the control member is mounted so as to be pivotable about a horizontal pivot axis. One of its ends is operatively connected with a two-stage mechanical switch, and the other end thereof is directed towards the pile support board and has stop surfaces thereon which cooperate with contact surfaces on the pile support board.

In pile lifting devices with an auxiliary pile device disposed above the main sheet pile, in accordance with another aspect of the invention, the control member is fastened to a fixed part of the auxiliary pile device so as to articulate about a horizontal axis and so that the switch elements of the first stage respond in every case before the sheet pile on the pile supporting board or the empty pile supporting board comes into contact with parts of the auxiliary pile device or extends into the range of movement of the grippers on the gripper bridges of the sheet conveying device.

In accordance with another feature of the invention, the two switching stages are provided in a mechanical switch actuatable by the control member and serially connected with two contactless transmitters, one of the transmitters being disposed on the control member and being capable of detecting at least one of a sheet pile, a pallet and a similar load on the pile support board and of switching the lifting unit drive to the slower operating speed, and the other of the transmitters being capable of detecting an uppermost surface of the sheet pile below a machine part in the collision region and of switching the lifting unit drive off. The other or second transmitter is serially connected with the second switching stage of the mechanical switch. Thereby, in addition to the mechanical protection of the pile support board without a sheet pile, protection is provided by the detection of a sheet pile on the pile support board and the switching of the lifting unit drive over to a slower speed promptly before the upper surface of the sheet pile can collide with the auxiliary pile device. Space for freedom of movement for the pressman thereby remains, for example, for operating a auxiliary pile device in non-stop operation. The lifting unit drive is switched off, preferably by a capacitive sensor, only directly before the upper surface of the sheet pile would reach the the grippers of a conveying device in the delivery, suction nozzles in the delivery or the like.

An advantage of this combination of a mechanical protective device for the lifting movement of the pile support board with an element for contactless protection is primarily in that even an empty pallet, if necessary or desirable, with its open side directed towards the control member, or a different pile table or a pallet whereon only a few sheets forming a very low sheet pile are disposed is detected by the ultrasonic sensor or the like, so that the lifting unit drive is switched over to a slower speed, this switch-over being so-to-speak confirmed when the control member, upon making contact with the pile support board, actuates the mechanical switch in the first switching stage, which is serially connected with the ultrasonic sensor. Machine operation with the use of an auxiliary pile device for non-stop operation affected or impaired because, in the case of normal machine operation, only the lifting unit drive is switched from fast speed over to the slower speed by the ultrasonic sensor arranged on the control member, the instant the upper surface of the sheet pile has reached a predetermined height below the range of movement of the auxiliary pile device. Further machine operation and control takes place manually in a conventional manner. The lifting unit drive is switched off by the second or other transmitter, which is preferably a capacitive transmitter, only if the sheet pile had been lifted so that its upper surface penetrates into the range of movement of revolving grippers for sheet conveyance or a suction roller in the delivery of the printing machine and also into the range of movement of possible suction nozzles or the like in the feeder of the printing machine, respectively. If necessary or desirable, this upper protection may also be effected with an ultrasonic sensor instead of a capacitive sensor.

Especially advantageous is the effectiveness of the protective system according to the invention independently of the format of the sheets in the the sheet pile and of the construction of a possible pile support board or other means introduced as pile supports or carriers.

In accordance with a further feature of the invention, the control member is mounted so as to be pivotable about a horizontal axis, the control member having an end engageable with the mechanical switch, and a free end directed at an inclination towards a contact surface on the pile support board.

In accordance with an added feature of the invention, an auxiliary pile device is disposed above the sheet pile and has a guide wherein an auxiliary pile support member of the auxiliary pile device is received, the control member being mounted on the guide of the auxiliary pile device so as to be swingable about a horizontal axis.

In accordance with an additional feature of the invention, a roller is mounted at the free end of the control member and is cooperatively engageable with the contact surface on the pile support board.

In accordance with a concomitant feature of the invention, the roller has a rolling bearing surface formed of elastic material.

Other features which are considered as characteristic for the invention are set forth in the appended claims.

Although the invention is illustrated and described herein as embodied in a protective system of a pile lifting device for sheet piles in sheet-fed printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
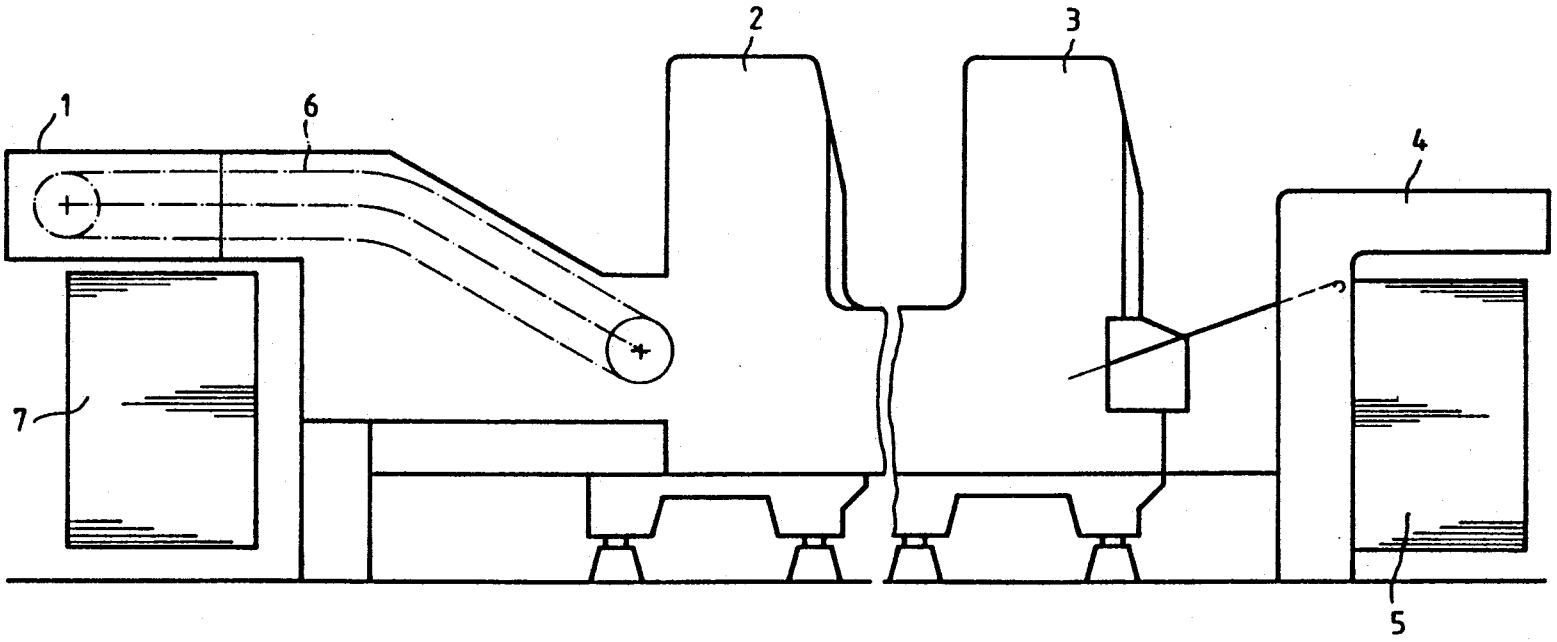
FIG. 1 is a diagrammatic side elevational view of a sheet-fed printing machine with a feeder having a pile lifting device, and a delivery having another pile lifting device.
Figure 4:
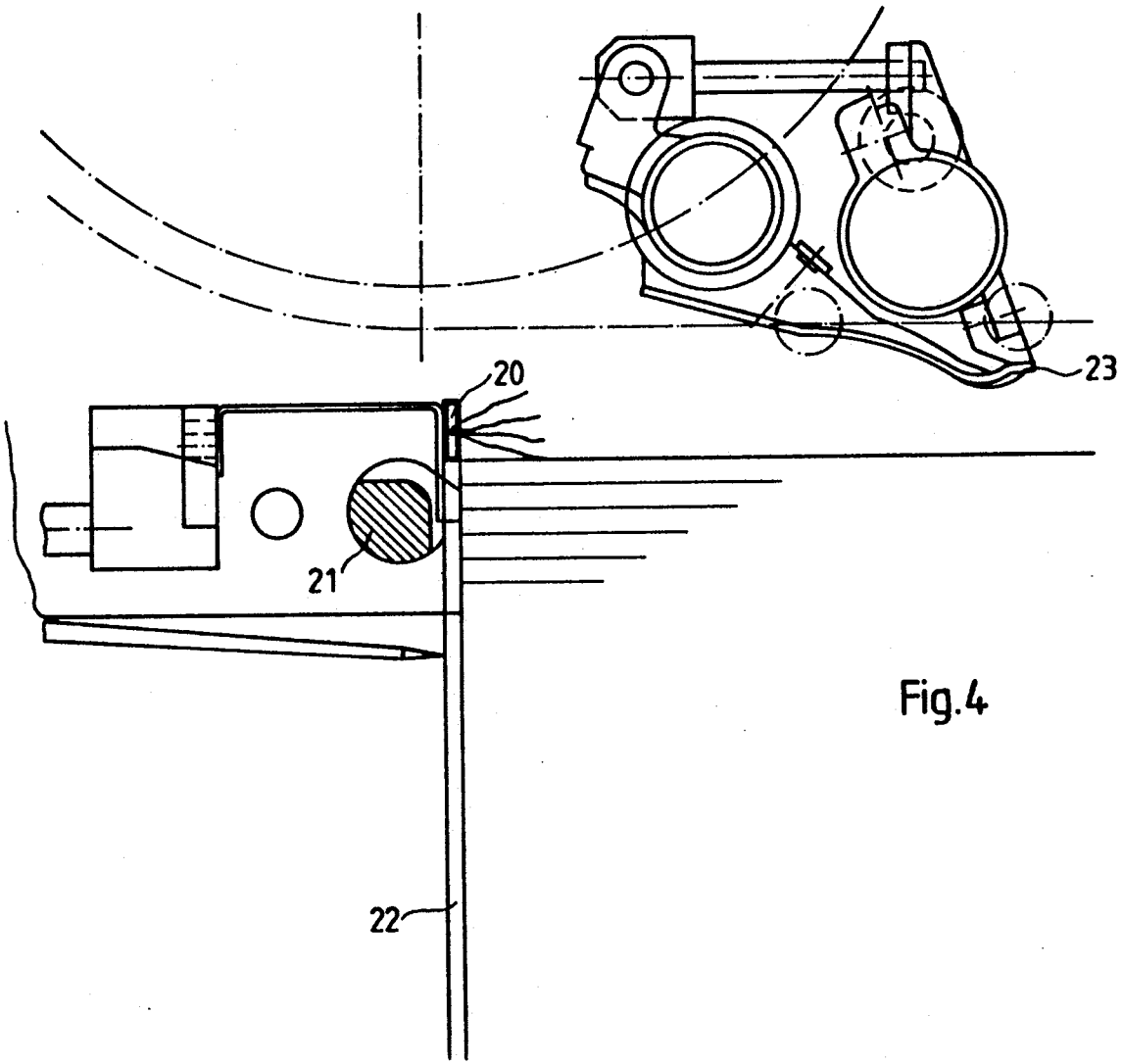
Figure 5:
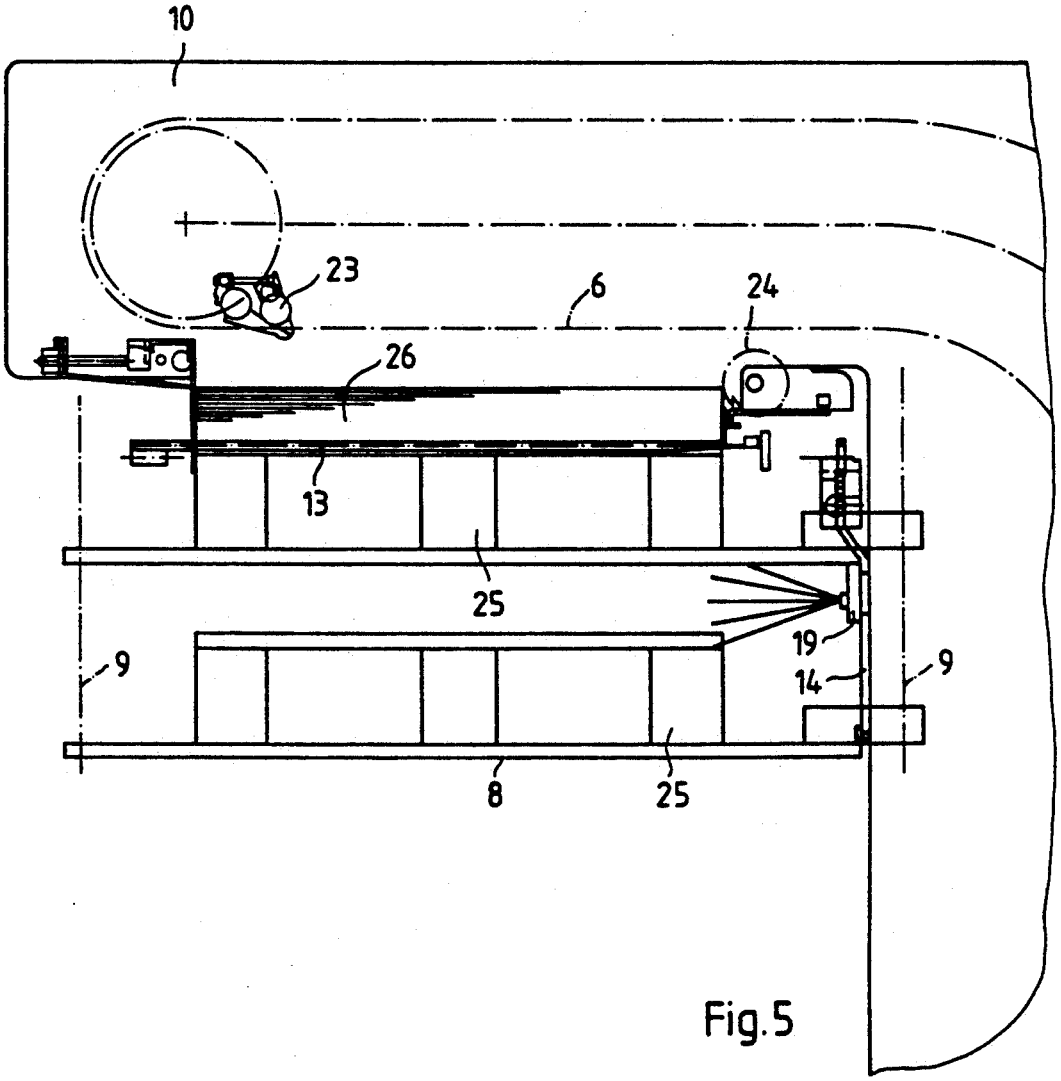
Figure 6:
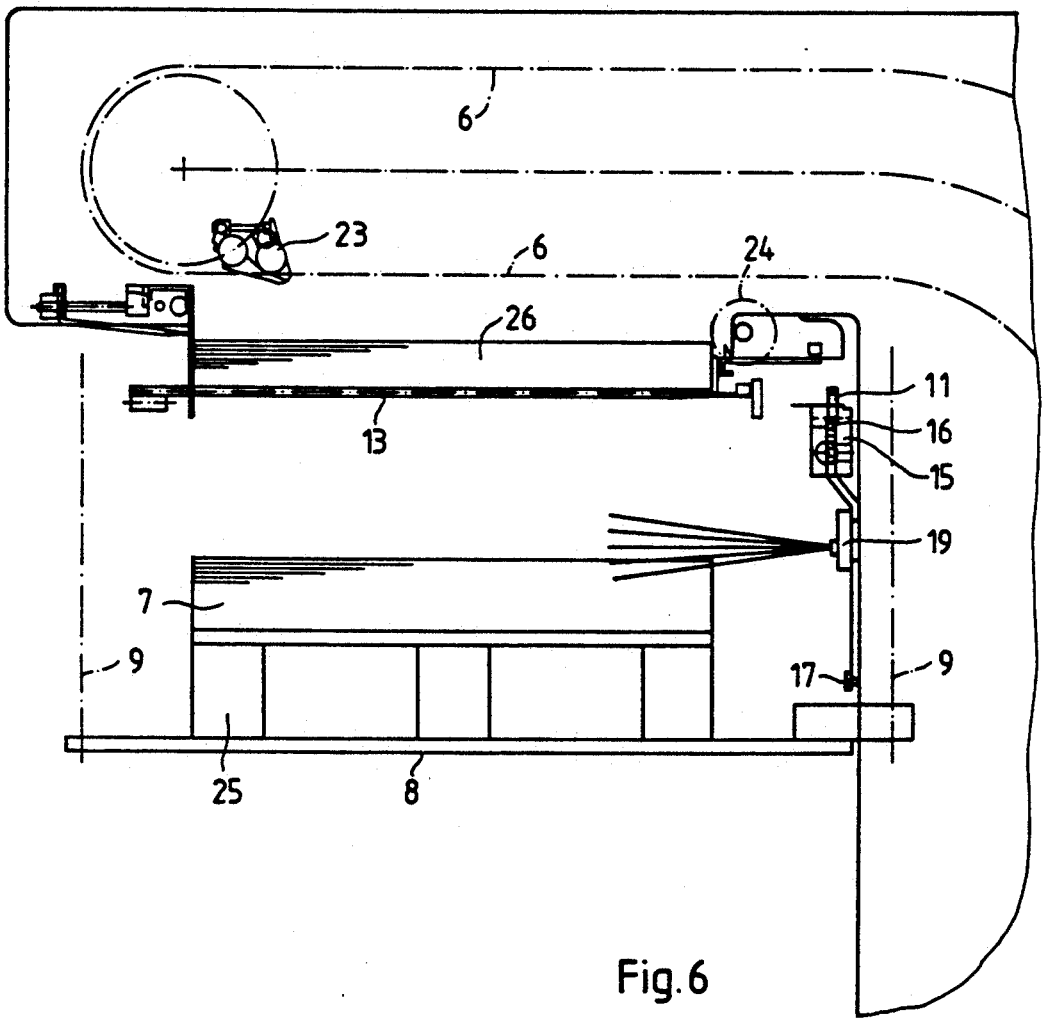
Figure 7:
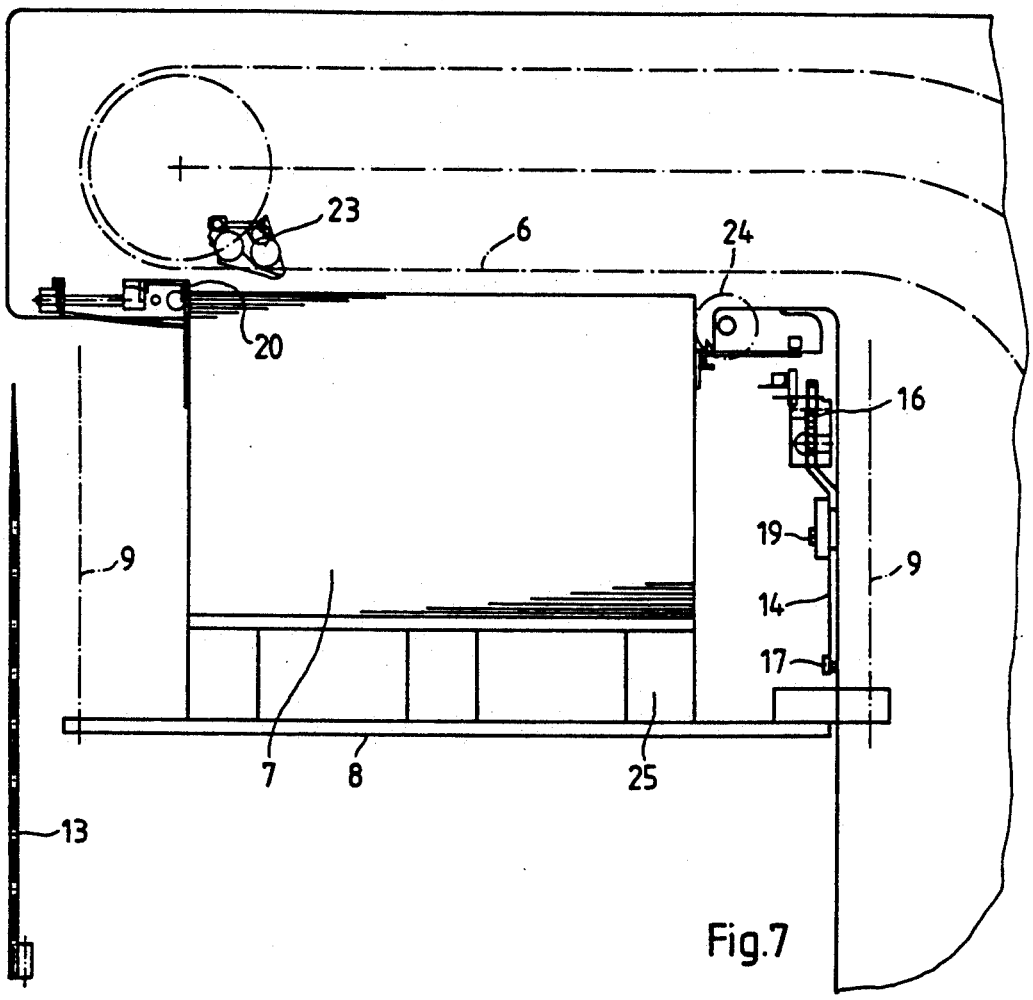

FIG. 4 is a fragmentary, much-enlarged view of FIG. 1 showing part of the delivery and the sheet stacking device thereof in greater detail; and FIGS. 5 to 7 are reduced-scale views of FIG. 4 and additional structural details of the delivery of the sheet-fed printing device and the sheet stacking device thereof in various positions of the pile support board thereof, with and without a sheet pile supported thereon.

Referring now to the figures of the drawing in detail and first, particularly, to FIG. 1 thereof, there is shown therein a sheet-fed printing machine with two printing units 2 and 3 thereof and a sheet feeder 4 and sheet delivery 1 thereof. Sheets lifted from a sheet pile 5 in the feeder 4 and fed into the printing units 2 and 3, are transported by a chain conveyor 6 on which non-illustrated gripper bridges with sheet grippers are fastened, to a location above the sheet pile 7 in the delivery, and are deposited thereat. Both of the sheet piles 5 and 7 are supported, as shown in FIG. 2, for example, on a pile support board 8, respectively, which is connected by chains 9 to an elevated lifting unit disposed thereabove.

Figure 2:
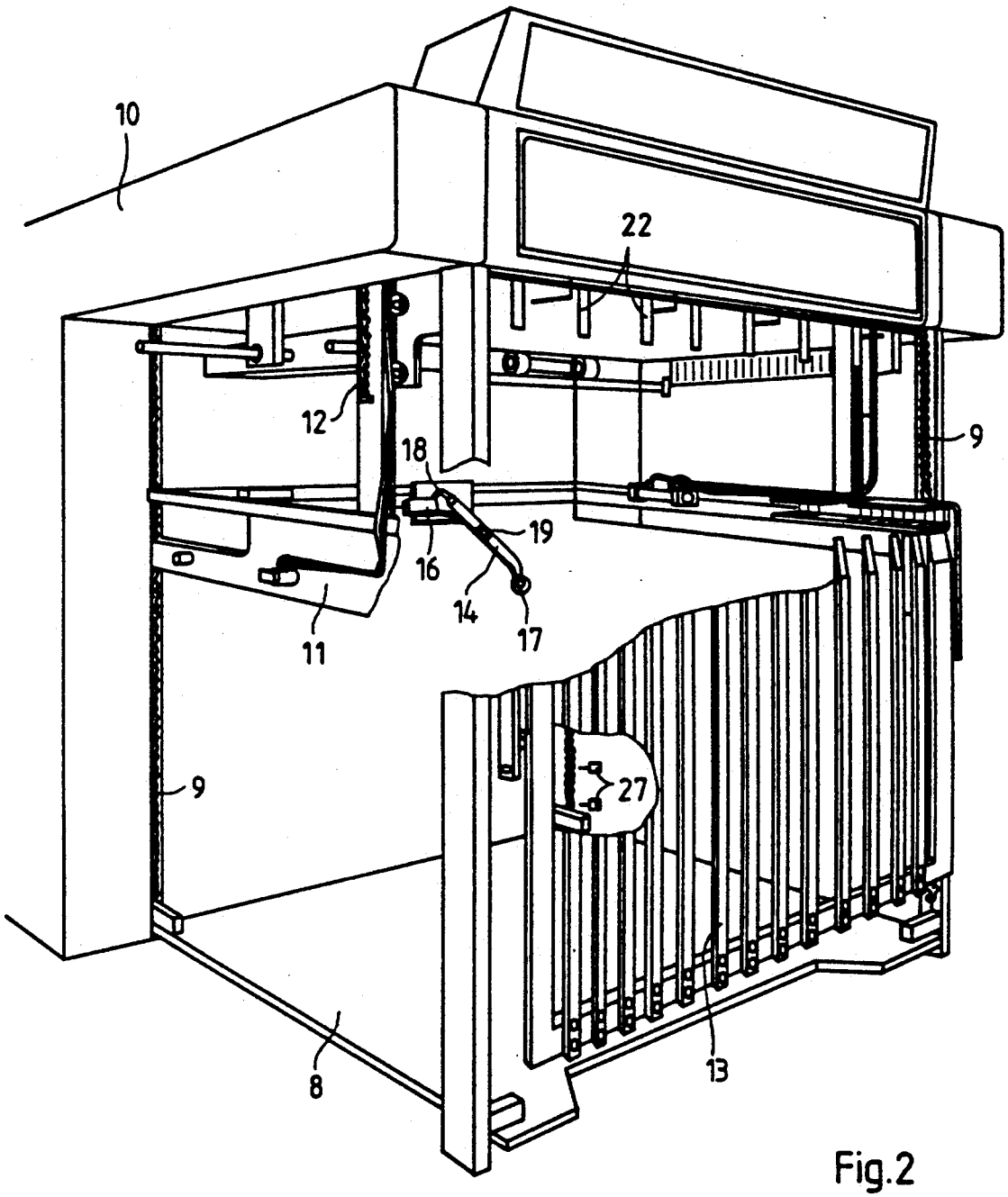
FIG. 2 is an enlarged fragmentary perspective view of FIG. 1, partly broken away and, in greater detail, showing the pile lifting device of the delivery of the sheet-fed printing machine.

As shown further in FIG. 2, the pile support board 8 for the sheet pile 7 is vertically displaceably held on guides and suspended at four corners thereof by pile lifting chains 9 by which it is connected to a lifting unit disposed thereabove in a frame 10 of the delivery 1. In the interest of clarity and of providing a better overall view, the lifting unit drive and the electrical control thereof are not illustrated in the drawing. To form an auxiliary pile above the main pile on the pile support board 8, an auxiliary pile device is provided from a fixed frame 11 which is likewise connected at several locations by auxiliary pile lifting chains 12 to an auxiliary pile lifting unit and, thereby, also being displaceable vertically on guides. This frame 11 has a horizontal support and a horizontal slide-in guide, respectively, for a rake 13 which, for the purpose of forming an auxiliary pile above the main pile, is upwardly swung from the illustrated vertical position thereof into a horizontal position and is inwardly slideable between sheets into the slide-in guide of the frame 11, so that oncoming sheets then deposit on the rake 13, and the main pile can be suitably changed in a conventional manner.

Figure 3:
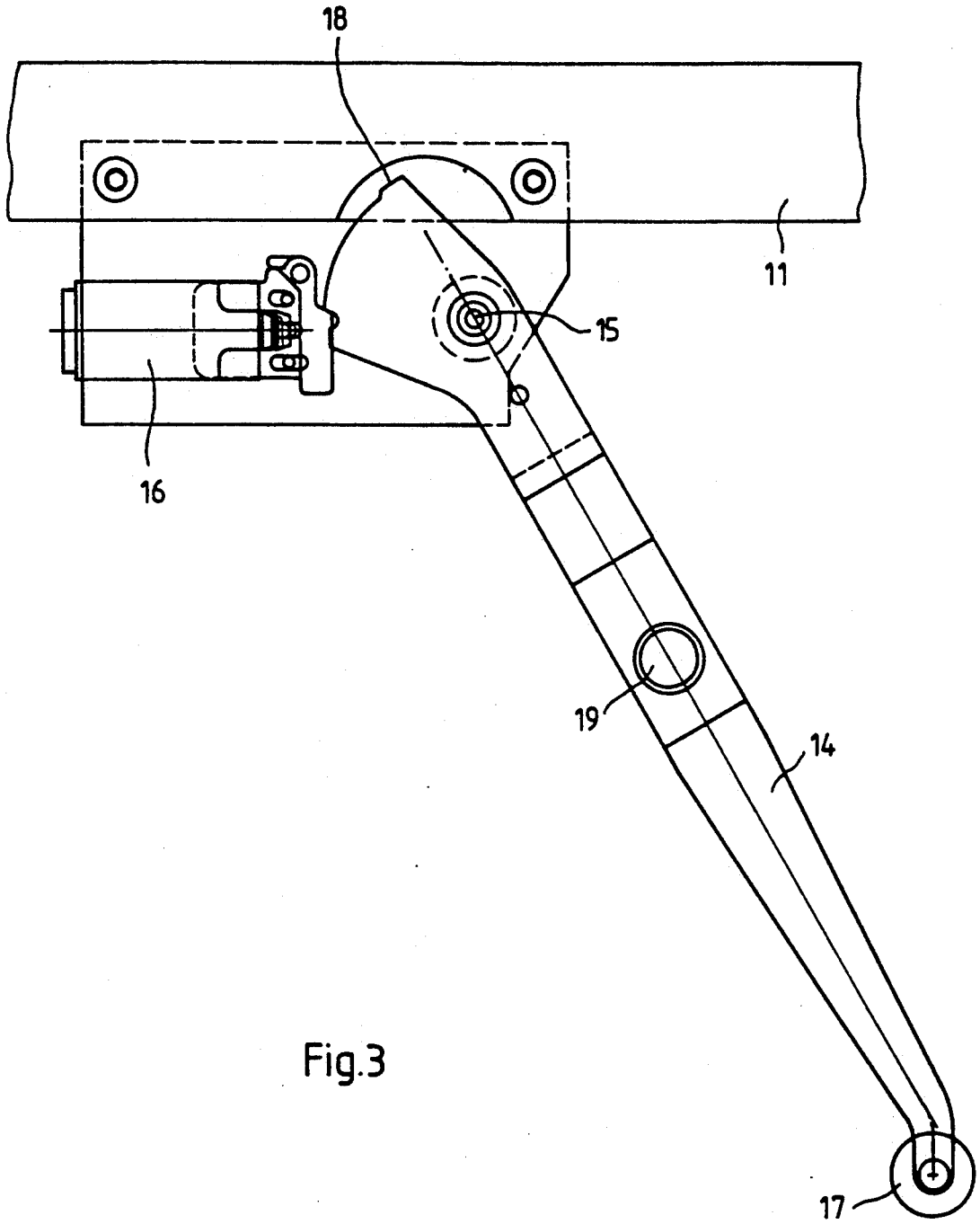
FIG. 3 is a much enlarged fragmentary elevational view of FIG. 2 showing, in greater detail, a control member according to the invention.

A control member 14 is articulatingly connected to a rear part of the frame 11, as viewed in FIG. 2, so as to be pivotable about a horizontal axis 15 (FIG. 3), and is formed of a double lever which cooperates with a mechanical two-stage switch 16 which has switch elements in a first switching stage and switch elements in a second switching stage. The control member 14, which extends downwardly in a direction towards the pile support board 8 and is inclined to the vertical, has a free end which cooperates with a stop surface of the pile support board 8 and is furnished advantageously with a roller 17 mounted freely rotatably thereon. The roller 17 is formed of an elastic material or is provided with a peripheral elastic covering thereon in order to minimize noise production when the roller 17 meets the stop surface of the pile support board 8. A result thereof is that the empty pile support board 8 moves upwardly from below as it approaches the auxiliary pile device, and moves against the the roller 17 so that the switch elements of the first switching stage of the two-stage switch 16 switches the lifting unit drive from fast speed to a considerably slower speed. A further upward movement of the pile support board 8 with or without a sheet pile supported thereon causes a further swing of the control member 14 about the axis 15. This further swing of the control member 14 leads finally to an actuation of the two-stage switch 16 into the second switching stage, for example, via a control cam 18, so that the drive circuit of the pile lifting unit drive is interrupted.

A first contactless transmitter 19, preferably an ultrasonic sensor, is furthermore fastened to the control member 14 and is connected in series with the switch elements of the first switching stage of the mechanically actuated two-stage switch 16. This contactless transmitter 19 detects a sheet pile on the pile support board 8 independently of the position thereof and of the format or size of the sheet in the sheet pile, as well as possibly also an empty pallet on the pile support board 8, and likewise effects a switch-over of the drive of the pile lifting unit from fast speed to the slower speed, even before the roller 17 has been engaged by the stop surface of the pile support board 8.

As shown in FIG. 4, a second contactless transmitter 20, preferably a capacitive transmitter, is disposed slightly above a conventional sheet slider shaft 21 on which leading edge stops 22 engaged by the sheets of the sheet pile are fastened in a transverse plane in a conventional manner. This second transmitter 20 detects the upwardly traveling sheet pile and switches the lifting unit drive off, even before the sheet pile has arrived within a range of displacement or travel, above the sheet pile, of a sheet gripper 23 revolving, as shown in FIG. 6, on the conveyor chain 6, and of a suction roller 24 disposed upstream thereof in the direction of travel of the conveyor chain 6.

The combined effect of the protective or safety elements according to the invention is apparent in individual operating stages from FIGS. 5 to 7.

Downward travel of an auxiliary pile during a pile change is illustrated in FIG. 5. Through the contactless transmitter 19 or through the mechanical switch 16 actuated by the control member 14 in the first switching stage, the lifting unit drive is initially switched over from fast speed to the slow speed, when the pile support board 8 with a pallet 25 supported thereby travels upwardly to a predetermined height (i.e. the lower position thereof in FIG. 5), so that the pressman can manually control the further lifting movement of the pile support board 8, until the pallet has been moved into an end position thereof (i.e. the upper position thereof in FIG. 5) under the rake 13 for non-stop operation. A is readily apparent, both the lower arrival position at which the switch-over occurs, as well as the upper end position are illustrated in FIG. 5.

A sheet pile 7 on a pallet or on another pile carrying table is shown disposed on the pile support board 8 in FIG. 6. When the pile support board 8 rides high, i.e. travels upwardly to a given height, the sheet pile 7 is detected by the contactless transmitter 19 on the control member 14, so that the drive is switched over from fast speed to the slower speed. Further lowering of the rake 13 with the auxiliary sheet pile 26 supported thereon is controlled manually by the pressman.

FIG. 7 illustrates the final switching-off of the lifting unit drive by the capacitive transmitter 20 disposed on the slider shaft 21 for protecting against the arrival of the sheet pile 7 within the range of movement or travel of the sheet gripper 23 revolving on the conveyor chain 6. It is apparent from the right-hand half of FIG. 7, that, in the case at hand, the mechanically actuated switch elements of the two-stage switch 16 ar not effective. The switch-over of the lifting unit drive from fast speed to the slow speed was effected by the contactless transmitter 19 which is fastened to the control member 14.

When the pile support board 8 is being lowered, in order to switch the drive therefor over from fast speed to a slower speed promptly before the pile support board 8 has reached its lower end position, a switch pair 27 (FIG. 2) is provided, of which the upper switch, upon contact with the pile support board 8, switches the pile lifting drive over from fast speed to the slower speed, so that the pile support board 8 travels slowly into its lower end position, and the lower switch of the switch pair 27 finally switches the pile lifting unit drive off.

The foregoing is a description corresponding in substance to German Application G 92 02 352.5, dated Feb. 24, 1992, the International priority of which is being claimed for the instant application, and which is hereby made part of this application. Any material discrepancies between the foregoing specification and the aforementioned corresponding German application are to be resolved in favor of the latter.

We claim:

1. Protective system of a pile lifting device for sheet piles in feeders and deliveries of sheet-fed printing machines, wherein a pile support board for supporting a sheet pile thereon is liftable and lowerable in guides of a frame by a motorized drive of a lifting unit controllable independently of the printing-machine drive, the motorized drive having at least one fast-speed operating condition and one comparatively slower speed operating condition for both the lifting and lowering directions of movement, the pile support board and a sheet pile supported thereby, respectively, being drivable by the motorized drive to a position switch and into a collision region in which it can collide with another machine part, comprising a control member operative between the pile support board and the sheet pile supported thereby, respectively, on the one hand, and a machine part present in the collision region, on the other hand, said control member being articulatingly fastened to at least one of a location in vicinity of the position switch and the machine part in the collision region, and having switch elements arranged in at least two switching stages for controlling the lifting unit drive, said switch elements being switched via contact surfaces formed on the pile support board and including a first plurality thereof arranged in a first one of said switching stages and a second plurality thereof arranged in a second switching stage, said first plurality of switch elements being located upstream of said second plurality of switch elements in a direction of mutual approach of the pile support board and the machine part in the collision region, said first plurality of switch elements being actuatable for switching the lifting unit drive from fast speed operation to a slower speed operation, and said second plurality of switch elements being actuatable for switching the lifting unit drive off.

2. Protective system according to claim 1, wherein said two switching stages are provided in a mechanical switch actuatable by said control member and serially connected with two contactless transmitters, one of said transmitters being disposed o said control member and being capable of detecting at least one of a sheet pile, a pallet and a similar load on the pile support board and of switching the lifting unit drive to the slower operating speed, and the other of said transmitters being capable of detecting an uppermost surface of the sheet pile below a machine part in the collision region and of switching the lifting unit drive off.

3. Protective system according to claim 2, wherein said control member is mounted so as to be pivotable about a horizontal axis, said control member having an end engageable with said mechanical switch, and a free end directed at an inclination towards a contact surface on the pile support board.

4. Protective system according to claim 1, including an auxiliary pile device disposed above the sheet pile and having a guide wherein an auxiliary pile support member of the auxiliary pile device is received, said control member being mounted on said guide of the auxiliary pile device so as to be swingable about a horizontal axis.

5. Protective device according to claim 3, including a roller mounted at said free end of said control member and cooperatively engageable with said contact surface on the pile support board.

6. Protective device according to claim 5, wherein said roller has a rolling bearing surface formed of elastic material.

* * * * *